US009531138B2

(12) United States Patent
Xing et al.

(10) Patent No.: US 9,531,138 B2
(45) Date of Patent: Dec. 27, 2016

(54) PLUG CONNECTOR ASSEMBLY HAVING SUPPORTING MEMBER TO SUPPORT INTERNAL PRINTED CIRCUIT BOARD

(71) Applicant: FOXCONN INTERCONNECT TECHNOLOGY LIMITED, Grand Cayman (KY)

(72) Inventors: Da-Wei Xing, Kunshan (CN); Jun Chen, Kunshan (CN); Jerry Wu, Irvine, CA (US)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/010,161

(22) Filed: Jan. 29, 2016

(65) Prior Publication Data

US 2016/0226200 A1 Aug. 4, 2016

(30) Foreign Application Priority Data

Feb. 4, 2015 (CN) ..... 2015 2 0077120

(51) Int. Cl.
*H01R 3/00* (2006.01)
*H01R 13/717* (2006.01)
*H01R 13/66* (2006.01)

(52) U.S. Cl.
CPC ..... *H01R 13/7172* (2013.01); *H01R 13/6658* (2013.01); *H01R 13/6691* (2013.01); *H01R 13/7175* (2013.01)

(58) Field of Classification Search
CPC . H01R 13/717; H01R 13/7175; H01R 13/641; H01R 13/6641; H01R 13/658
USPC ..... 439/488–490, 607.56, 0.57
See application file for complete search history.

(56) References Cited

U.S. PATENT DOCUMENTS 6,957,976 B2 * 10/2005 Zhang ..... H01R 13/6275 439/358
7,429,188 B2 * 9/2008 Wu ..... H01R 13/7172 439/490
8,475,203 B2 * 7/2013 Wu ..... H01R 13/6658 439/490
9,450,350 B2 * 9/2016 Chen ..... H01R 13/717

FOREIGN PATENT DOCUMENTS

CN 102761035 10/2012
CN 103124031 5/2013

* cited by examiner

*Primary Examiner* — Hien Vu
(74) *Attorney, Agent, or Firm* — Wei Te Chung; Ming Chieh Chang

(57) ABSTRACT

A plug connector assembly (1) includes: a mating member (10) for receiving a mating connector; a printed circuit board (20) electrically connected with the mating member; an outer shell (60) enclosing the printed circuit board; a light member mounted on the printed circuit board; and a light pipe (50) mounted on the printed circuit board to transmit light emitted from the light member to an outer side of the outer shell; wherein the outer shell comprises at least one supporting member (624) extending inwardly to support the printed circuit board in order to prevent the printed circuit board from movement during mounting the light pipe to the printed circuit board.

13 Claims, 7 Drawing Sheets

PLUG CONNECTOR ASSEMBLY HAVING SUPPORTING MEMBER TO SUPPORT INTERNAL PRINTED CIRCUIT BOARD

BACKGROUND OF THE INVENTION

1. Field of the Invention

The present invention relates to a plug connector assembly, and more particularly to a plug connector assembly having a structure for a light pipe to be conveniently mounted.

2. Description of Related Arts

China Patent Application Publication No. CN103124031, published on May 29, 2013, discloses a plug connector assembly. The plug connector assembly comprises insulative housing, a plurality of contacts mounted in the insulative housing, a cable electrically connected with the contacts, a cover enclosing a portion of the cable, and a printed circuit board assembly mounted on the cover. The printed circuit board assembly comprises a printed circuit board, a light source, and a light pipe. The printed circuit board is supported by the cover when the light pipe is pressed on the printed circuit board. China Patent Application Publication No. CN102761035, published on Oct. 31, 2012, discloses a plug comprising an insulative housing, a metal shell enclosing the insulative housing, a printed circuit board received in the insulative housing, and a cable electrically connected with the printed circuit board. The metal shell defines a pair of slots at opposite side walls. The printed circuit board comprises a pair of tabs extending outwardly and received in the slots respectively.

An improved plug connector assembly is desired to offer advantages over the related art.

SUMMARY OF THE INVENTION

An object of the present invention is to provide a plug connector assembly having a support member to support an internal printed circuit board so as to prevent the printed circuit board from movement during mounting other components onto the printed circuit board.

To achieve the above-mentioned object, a plug connector assembly comprises: a mating member for receiving a mating connector; a printed circuit board electrically connected with the mating member; an outer shell enclosing the printed circuit board; a light member mounted on the printed circuit board; and a light pipe mounted on the printed circuit board to transmit light emitted from the light member to an outer side of the outer shell; wherein the outer shell comprises at least one supporting member extending inwardly to support the printed circuit board in order to prevent the printed circuit board from movement during mounting the light pipe to the printed circuit board.

According to the present invention, the outer shell of the plug connector assembly comprises at least one supporting member to support the printed circuit board when the light pipe is pressed onto the circuit board. Therefore, the printed circuit board can be kept in right position.

DETAILED DESCRIPTION OF THE PREFERRED EMBODIMENT

Figure 1:
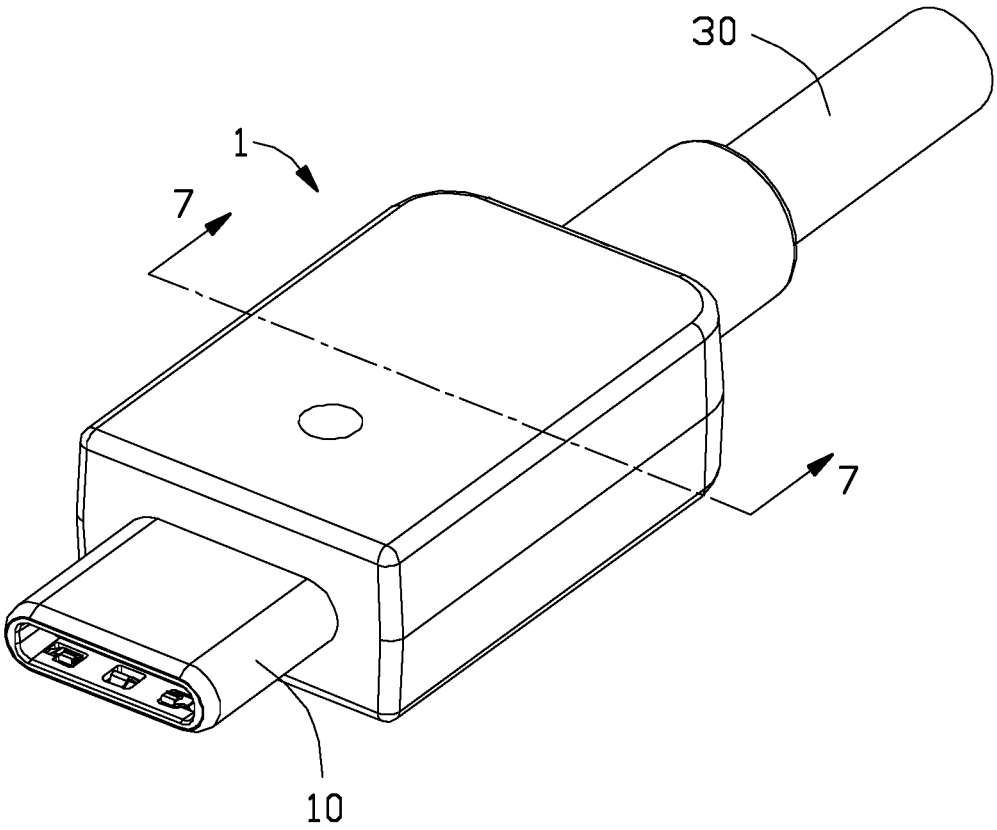
FIG. 1 is a perspective view of a plug connector assembly in accordance with the present invention.
Figure 2:
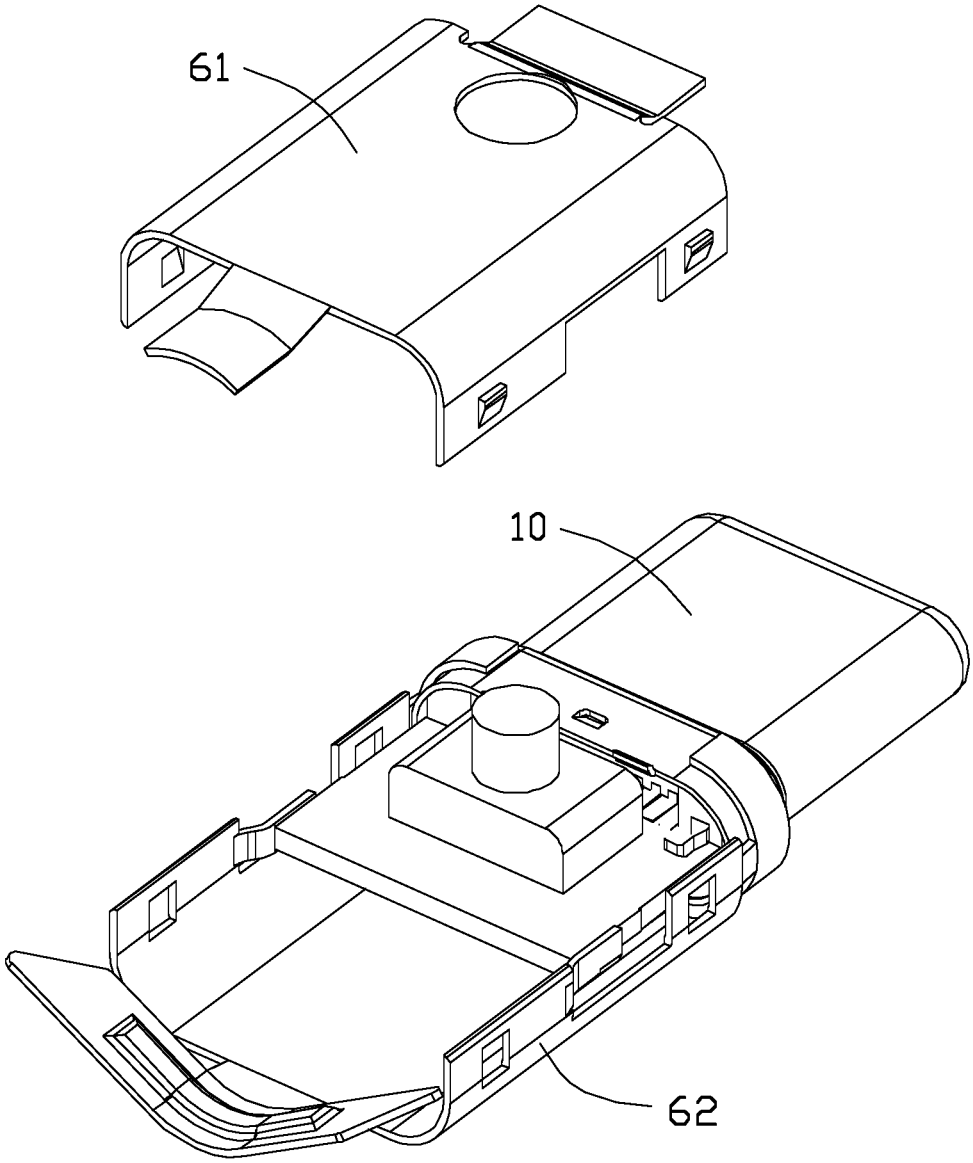
FIG. 2 is a partially exploded view of the plug connector assembly as shown in FIG. 1.
Figure 3:
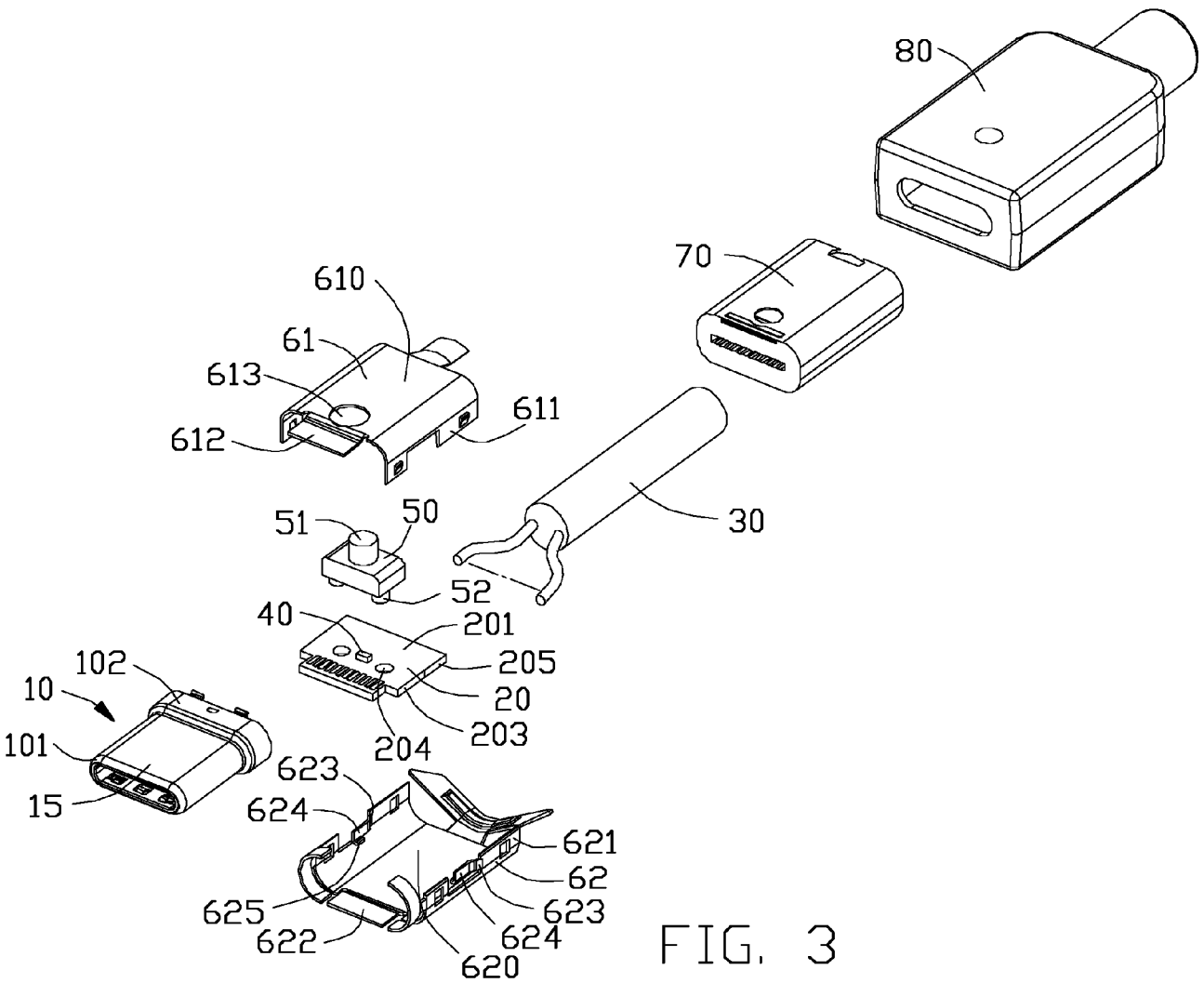
FIG. 3 is an exploded view of the plug connector assembly as shown in FIG. 2.
Figure 4:
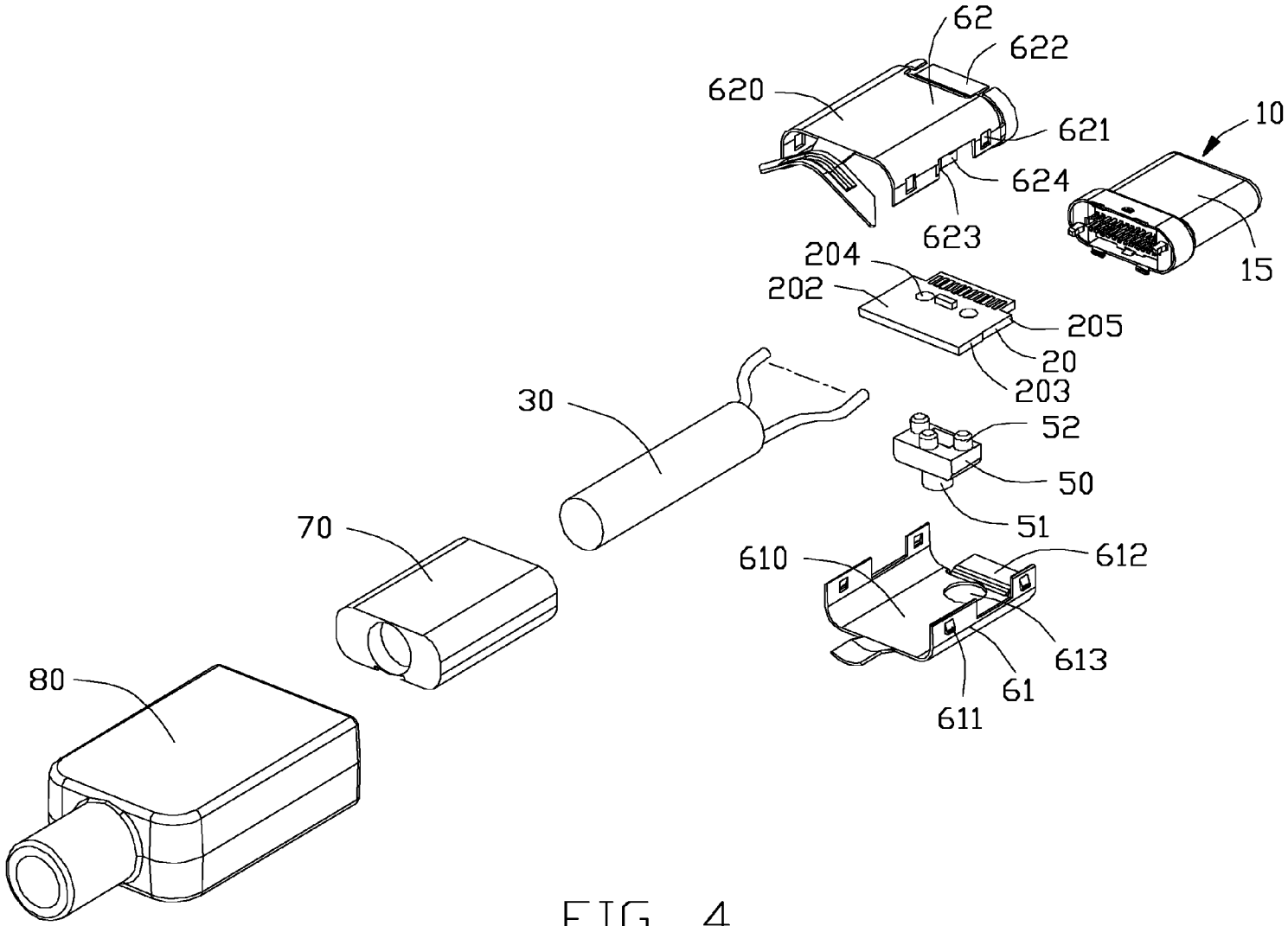
FIG. 4 is a another view of the plug connector assembly as shown in FIG. 3.

Reference will now be made in detail to a preferred embodiment of the present invention.

Referring to FIGS. 1-7, a plug connector assembly 1 in accordance with the present invention comprises a mating member 10, a printed circuit board 20, a cable 30 electrically connected with the printed circuit board 30, a light member 40 mounted on the printed circuit board 30, a light pipe or waveguide 50 mounted on the printed circuit board 20 to transmit the light from the light member 40 to outside for users to observe, a metal outer (rear) shell 60 enclosing the printed circuit board 20, an inner molding filled between the printed circuit board 20 and the outer shell 60, and an outer molding 80 over molded with outer shell 60. The plug connector is in accordance with USB C type standard which supports mating in two orientations.

Figure 5:
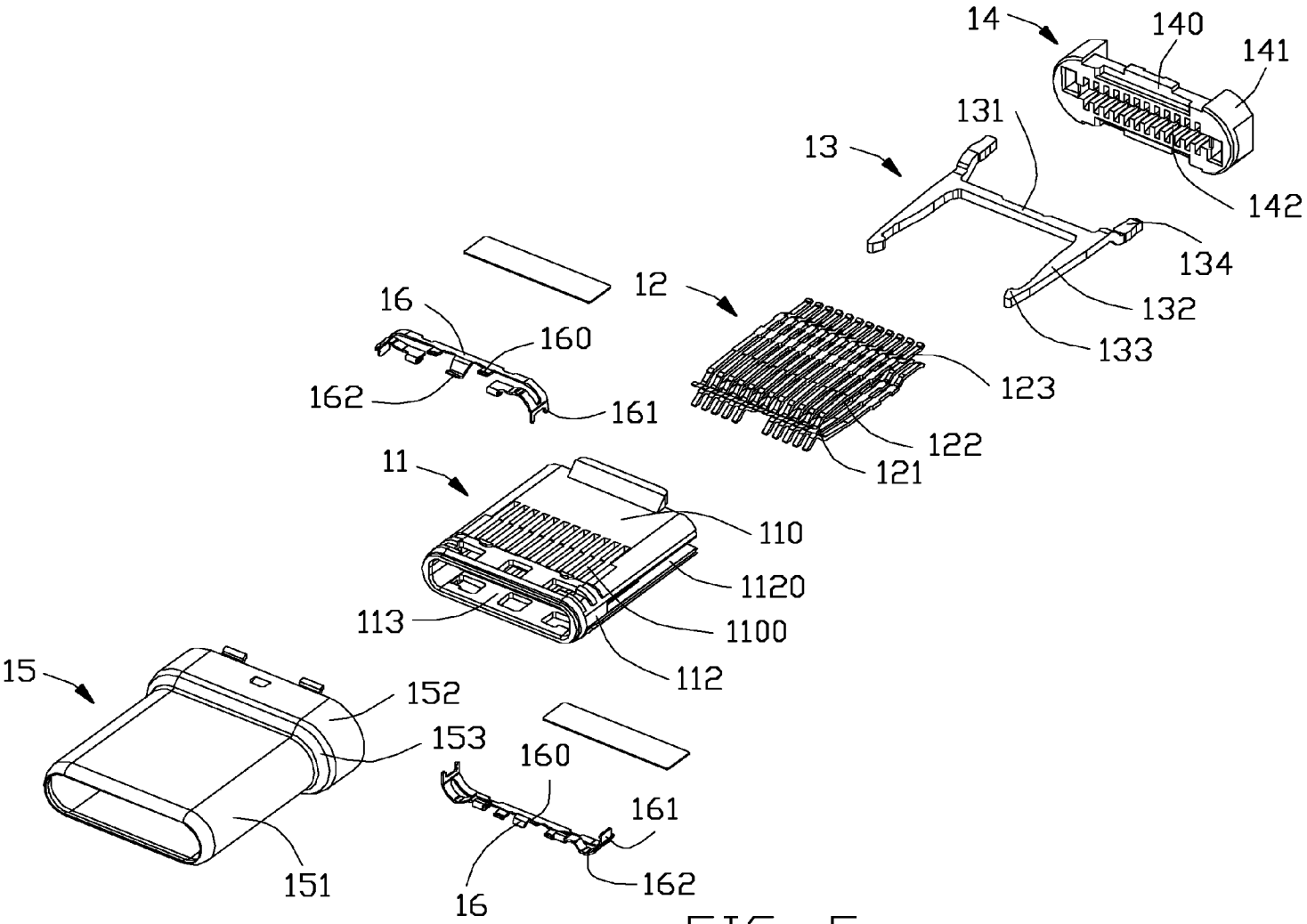
FIG. 5 is an exploded view of a mating member of the plug connector assembly as shown in FIG. 1.
Figure 6:
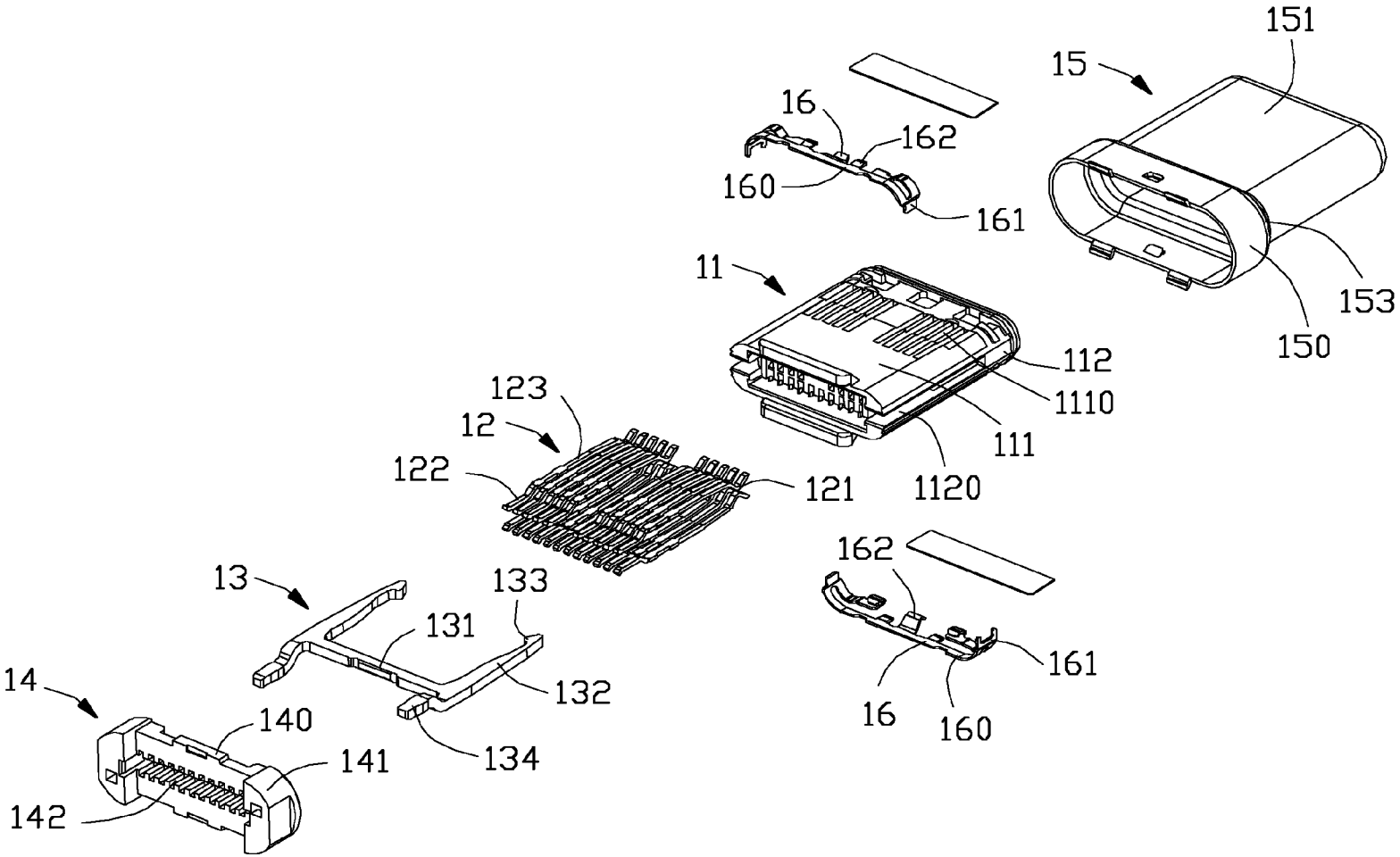
FIG. 6 is another exploded view of the mating member of the plug connector assembly as shown in FIG. 5.
Figure 7:
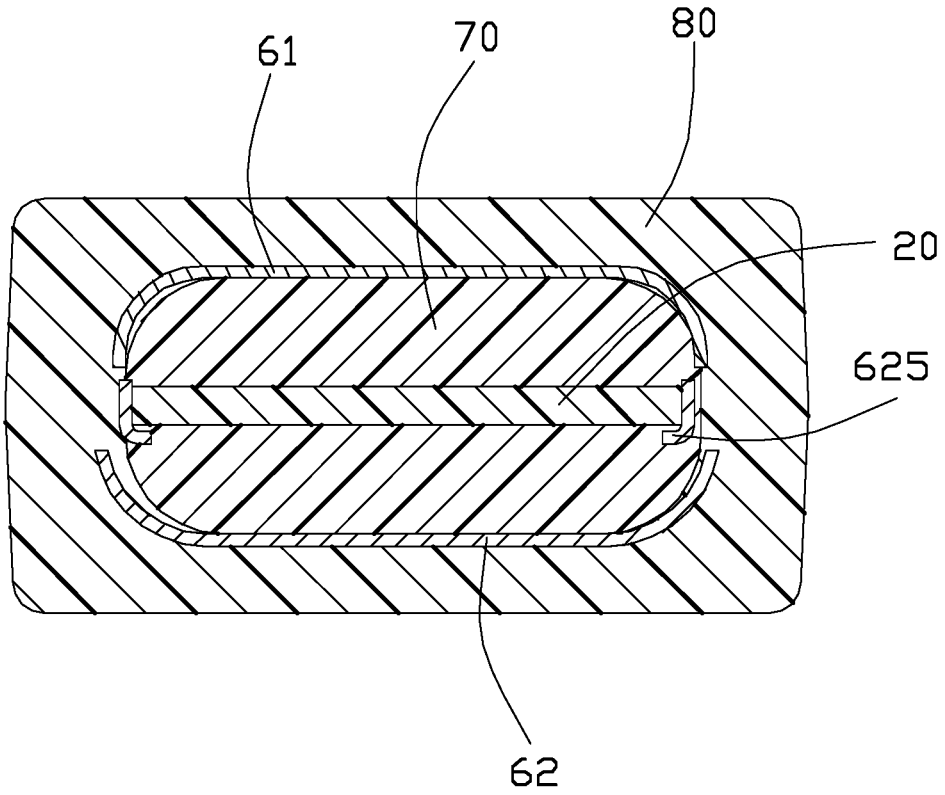
FIG. 7 is a cross-sectional view of the optical module taken along line 7-7 of FIG. 1.

Referring to FIGS. 5 and 6, the mating member 10 comprises a front mating end 10 for being inserted into the mating connector and an opposite rear mating end 102. The mating member 10 comprises an insulative housing 11, a plurality of contacts 12 arranged in two rows and spaced apart along vertical direction, a latch member 13 disposed between the two rows of the contacts 12 for being latched with the mating connector, an insulative member 14 disposed at a rear end of the insulative housing 11, a metal (front) shell 15 enclosing the insulative housing 11 and the insulative member 14, and a pair of grounding members 16 disposed at opposite sides of the insulative housing 11, respectively, and electrically connected with the metal shell 15.

The insulative housing 11 comprises a top wall 110, a bottom wall 111 parallel to the top wall 110, a pair of side walls 112 spaced apart from and parallel to each other, and a receiving room 113 formed thereby. The top wall 110 defines a top recess 1100 in communication with the receiving room 113 for receiving one of the grounding members 16, and the bottom wall 111 defines a bottom recess 1110 in communication with the receiving room 11 for receiving the other grounding member 16. Each of the side walls defines a slot 1120 extending from a rear end of the insulative housing 11 but not passing through a front end of the insulative housing 11.

Each of the contacts 12 comprises a front mating portion 121 extending forwardly, a rear mating portion 122 extending rearwardly 122, and a retention portion 123 connected between the front mating portion 121 and the rear mating portion 122 and retained by the insulative housing 11. The front mating portion 121 is mated with the mating connector, and the rear mating portion 122 is mated with the printed circuit board 20. The front mating portions 121 of the upper row contacts 12 are arranged face to face with the front mating portions 121 of the lower row contacts 12.

The latch member 13 comprises a base 131 extending laterally, a pair of latch beams 132 extending from opposite ends of the base 131 respectively, a pair of latch portions 133 disposed at respective free ends of the latch beams 132, and a pair of mounting portions 134 extending rearwardly from opposite ends of the base 131 respectively. The pair of latch portions is arranged face to face along the transverse direction. The pair of mounting portions is offset along vertical direction. The latch member 13 is mounted to the insulative housing along a rear to front direction. The pair of latch beams are received in the slots 1120, respectively.

The insulative member 14 cooperates with the insulative housing 11 to fix the latch member 13. The insulative member 14 comprises an insulative base 140, a pair of extending portions 141 extending rearwardly from opposite ends of the insulative base 140 respectively, and a plurality of through holes 142 extending through the insulative base 140 along the rear to front direction and arranged in two rows along a vertical direction. The mounting portions 134 of the latch member 13 extend through the though holes 142 and are soldered on opposite sides of the printed circuit board 20. The rear mating portions 122 of the contacts extend through the through holes and are soldered on opposite sides of the printed circuit board 20.

The metal shell 15 has a closed circumference that has good seal performance and good anti-EMI performance. The closed circumference of the metal shell 15 could be formed by sheet metal drawing, bend metal piece, die casting, etc. The metal shell 15 comprises a front end 151 for being inserted into the mating connector, a rear end 152 mated with the outer shell 60, and a transition portion 153 connected the front end 151 and the rear end 152.

Each of the grounding members 16 comprises a flat body 160, a pair of mounting portions 161 extending from opposite sides of the flat body 160 and toward the insulative housing 11 for being mounted to the insulative housing 11, and a plurality of contact portions 162 extending from a front side and into the receiving room 113 for being mated with the mating connector.

Referring to FIGS. 1-4 and 7, the printed circuit board 20 is disposed between the mating member 10 and the cable 30 to establish an electrical connection between the mating member 10 and the cable 30. The printed circuit board 20 comprises a top face 201, a bottom face 202 opposite to the top face 201, a pair of side faces 203 connecting the top and bottom faces 201 and 202 in left and right sides respectively, and a pair of mounting holes 204 extending through the top and the bottom faces 201 and 202. The light member 40 is mounted on a top face 201 of the printed circuit board 20. Each of the side faces 203 of the printed circuit board 20 comprises a soldering area 205.

The light pipe 50 is mounted on the top face 201 of the printed circuit board 20. The light pipe 50 comprises a guide post 51 to transmit the light emitted from the light member 40 to an outer side of the outer shell 60, and a pair of mounting posts 52 extending downwardly to interference fit with the mounting holes 204 of the printed circuit board 20 to fix the light pipe 50 to the printed circuit board 20.

Referring to FIGS. 2-4 and 7, the outer shell 60 comprises an upper shell 61 and a lower shell 62 latched to the upper shell 61. The upper shell 61 comprises a top wall 610, a pair of side wall 611 extending downwardly from opposite sides of the top wall 610, and a mounting portion 612 disposed at a front end of the top wall 610. The top wall defines a through hole 613 for receiving the guide post 51 of the light pipe 50. The lower shell 62 comprises a bottom wall 620, a pair of side walls 621 extending upwardly from opposite sides of the bottom wall 620 respectively, and a mounting portion 622 disposed at a front end of the bottom wall 620. Each of the side wall 621 comprises a connecting beam 623 extending inclined and inwardly, a soldering portion 624 extending from a free end of the connecting beam 623 and parallel to the side walls 621 of the bottom wall 620, and a supporting member 625 extending vertically from the a bottom portion of each of the soldering portion 624. The soldering portions 624 are soldered with the soldering areas 205 respectively to keep the printed circuit board 20 in a middle portion of the outer shell 60. Each of the supporting members 625 is supported the bottom face 202 of the printed circuit board 20. The soldering portions 624 are soldered with the soldering areas 205 prior to mounting the light pipe 50 onto the printed circuit board 20 in order to prevent the printed circuit board 20 from movement. Understandably, via supporting from the soldering portion 624 or the supporting member 625, the printed circuit board 20 no longer extends in a cantilevered beam type but in a fixed beam type (via the soldering portion 624) or a restrained beam type (via the supporting member 625), disregarding the connection between the cable 30 and the printed circuit board 20. Alternately, the supporting member 625 may be soldered upon the printed circuit board 20 to replace the soldering portion 624. The mounting portions 612, 622 of the upper and lower shells are disposed at and soldered with an outer side of the rear mating end 102 of the mating member 10.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A plug connector assembly comprising:

a mating member for receiving a mating connector;

a printed circuit board electrically connected with the mating member;

a metallic outer shell enclosing the printed circuit board;

a light member mounted on the printed circuit board; and a light pipe mounted on the printed circuit board to transmit light emitted from the light member to an outer side of the outer shell;

wherein the outer shell comprises at least one supporting member extending inwardly to support the printed circuit board in order to prevent the printed circuit board from movement during mounting the light pipe to the printed circuit board;

wherein the outer shell comprises an upper shell and a lower shell latched with the upper shell;

wherein the printed circuit board comprises a top face, a bottom face opposite to the top face, and a pair of side faces connected with the top and the bottom faces, the light member and the light pipe mounted on the top face;

wherein the lower shell comprises a bottom wall and a pair of side walls extending upwardly from opposite sides of the bottom wall, respectively, each of the side wall comprising a connecting beam extending inclined and inwardly and a soldering portion extending from a free end of the connecting beam and parallel to the side walls of the bottom wall, each of the side faces of the printed circuit board comprising a soldering area, the soldering portions soldered with the soldering areas respectively to keep the printed circuit board in a middle portion of the outer shell; and wherein the soldering portions are soldered with the soldering areas prior to mounting the light pipe onto the printed circuit board.

2. The plug connector assembly as recited in claim 1, wherein there are a pair of supporting members, each of the supporting members vertically extending from a corresponding soldering portion to support the bottom face of the printed circuit board.

3. The plug connector assembly as recited in claim 1, wherein the printed circuit board defines a pair of mounting holes extending through the top and bottom faces of the printed circuit board, and the light pipe comprises a pair of mounting posts extending downwardly to interference fit with the mounting holes to fix the light pipe to the printed circuit board.

4. The plug connector assembly as recited in claim 3, wherein the upper shell defines a though hole, and the light pipe comprises a guide post extending upwardly and received in the through hole.

5. The plug connector assembly as recited in claim 1, wherein the mating member comprises a front mating end and a rear mating end, and the lower shell comprises a mating portion enclosing and soldered to an outer side of the rear mating end.

6. The plug connector assembly as recited in claim 5, further comprising an outer molding over-moldered with the outer shell.

7. A plug connector comprising:

a mating member including an insulative housing defining a receiving cavity, which forwardly communicates with an exterior in a front-to-back direction, and enclosed within a metallic front shell, a plurality of contacts disposed in the housing with front mating sections extending into the receiving cavity and rear connecting sections along the front-to-back direction;

a printed circuit board positioned behind the housing in the front-to-back direction, and including along the front-to-back direction a front region where the connecting sections are soldered and a rear region, said printed circuit board defining two opposite surfaces in a vertical direction perpendicular to said front-to-back direction, said printed circuit board extending rearwardly behind the housing;

a cable located behind the printed circuit board and including wires electrically and mechanically connected to the rear region of the printed circuit board;

a light emitting device mounted upon one of said two opposite surfaces of the printed circuit board;

a light waveguide mounted upon said one of the two opposite surfaces of the printed circuit board and essentially covering the light emitting device in the vertical direction;

a metallic rear shell enclosing both two opposite surfaces of the printed circuit board;

wherein said rear shell forms a supporting member abutting against the other of said two opposite surfaces of the printed circuit board for supporting the printed circuit board during mounting the light waveguide upon said one of the two opposite surfaces of the printed circuit board;

wherein said supporting member is positioned adjacent to one lateral side edge of the printed circuit board; and wherein said rear shell further includes a soldering portion unitarily formed associatively with the supporting member and soldered upon a side edge of the printed circuit board in a transverse direction perpendicular to both said front-to-back direction and said vertical direction.

8. The plug connector as claimed in claim 7, wherein said rear shell forms a through hole through which the light waveguide extends in the vertical direction.

9. The plug connector as claimed in claim 8, further including an outer molding shielding the rear shell, wherein said light waveguide extends through the outer molding to be exposed to the exterior in the vertical direction.

10. The plug connector as claimed in claim 8, wherein said rear shell includes in the vertical direction opposite first and second parts assembled to each other in the vertical direction to respectively shield said one and said other of the two opposite surfaces of the printed circuit board, and wherein the supporting member is formed on the second parts which shield the other of said two opposite surfaces in the vertical direction while the through hole is formed in said first part which shield said one of the two opposite surfaces in the vertical direction.

11. The plug connector as claimed in claim 8, wherein the rear shell is assembled with the front shell.

12. The plug connector as claimed in claim 7, wherein via supporting from the supporting member, the printed circuit board operates in a manner of a restrained beam type.

13. A plug connector comprising: a mating member including an insulative housing defining a receiving cavity, which forwardly communicates with an exterior in a front-to-back direction, and enclosed within a metallic front shell, a plurality of contacts disposed in the housing with front mating sections extending into the receiving cavity and rear connecting sections along the front-to-back direction;

a printed circuit board positioned behind the housing in the front-to-back direction, and including along the front-to-back direction a front region where the connecting sections are soldered and a rear region, said printed circuit board defining two opposite surfaces in a vertical direction perpendicular to said front-to-back direction, said printed circuit board extending rearwardly behind the housing; a cable located behind the printed circuit board and including wires electrically and mechanically connected to the rear region of the printed circuit board;

light emitting device mounted upon one of said two opposite surfaces of the printed circuit board;

a light waveguide mounted upon said one of the two opposite surfaces of the printed circuit board and essentially covering the light emitting device in the vertical direction;

a metallic rear shell enclosing both two opposite surfaces of the printed circuit board;

wherein said rear shell includes a support member abutting against a surface of the printed circuit board and a soldering portion soldered to the printed circuit board to support the printed circuit board during mounting the light waveguide upon the printed circuit board so as to have said printed circuit board operate in a manner of a fixed beam type; and wherein the soldering portion is positioned adjacent to one lateral side edge of the printed circuit board in a transverse direction perpendicular to both said font-to-back direction and said vertical direction.

* * * * *